US009245441B1

(12) United States Patent
Poojary

(10) Patent No.: US 9,245,441 B1
(45) Date of Patent: Jan. 26, 2016

(54) SMART REMOTE CONTROLLER HANDSET

(71) Applicant: ICONNECTZONE, INC., Irvine, CA (US)

(72) Inventor: Sanjay Poojary, Irvine, CA (US)

(73) Assignee: ICONNECTZONE, INC, Irvine, CA (US)

( * ) Notice: Subject to any disclaimer, the term of this patent is extended or adjusted under 35 U.S.C. 154(b) by 262 days.

(21) Appl. No.: 14/076,949

(22) Filed: Nov. 11, 2013

Related U.S. Application Data

(60) Provisional application No. 61/725,105, filed on Nov. 12, 2012.

(51) Int. Cl.
*G08C 17/02* (2006.01)

(52) U.S. Cl.
CPC ..... *G08C 17/02* (2013.01); *G08C 2201/93* (2013.01)

(58) Field of Classification Search
CPC .... G08C 2201/93; G08C 17/02; G08C 17/00; H04M 1/0214; H04M 1/72533; H04M 11/085; H04N 5/4403; H04N 7/14; H04N 21/4222; H04N 21/42222; G08B 1/08; G08B 5/222; G08B 21/0423; G08B 25/016; G08B 25/12; G08B 25/10; H04W 84/00; H04W 68/00; A61F 4/00; A61G 7/0507; A61G 2007/0514; A61G 2007/0524; A61G 2203/12; G07C 9/00182; G07C 2009/00793; A63H 30/04
USPC ..... 340/4.11, 12.5
See application file for complete search history.

(56) References Cited

U.S. PATENT DOCUMENTS

| | | | | |
|---|---|---|---|---|
| D489,047 | S | 4/2004 | Luckett | |
| 6,853,308 | B1 * | 2/2005 | Dustin | H01H 9/0235 340/12.53 |
| 8,068,882 | B2 * | 11/2011 | Davis | G06F 1/1632 381/300 |
| 8,077,846 | B2 | 12/2011 | Gonzales | |
| 2009/0069002 | A1 * | 3/2009 | Shin | H04M 11/007 455/419 |
| 2010/0184379 | A1 * | 7/2010 | Shimomura | H04W 88/16 455/41.3 |

OTHER PUBLICATIONS

Affordable Marketing Solutions; http://www.storesonline.com/site/381729/product/498; "Cordless Phone/TV Remote Combo".

* cited by examiner

*Primary Examiner* — Omer S Khan

(57) ABSTRACT

The present invention features a smart remote controller system which can also receive phone calls from any mobile device via Bluetooth. The system comprises a remote controller, at least a smartphone, and an optional docking station. This remote controller has speakers and can stream music from the mobile device via Bluetooth while the device is charging on the docking station. The smart remote controller is banana shaped remote which fits comfortable in a user's palm. The top curved area is to control TV, DVR and other devices needing remote controller. The inner face is designed to be a comfortable ear to mouth piece to make/answer calls via the mobile device. One side is a Wi-Fi speaker system playing back music from any mobile device. The handset can be conveniently charged on the docking station when not in use.

21 Claims, 7 Drawing Sheets

SMART REMOTE CONTROLLER HANDSET

CROSS REFERENCES

This application claims priority to Provisional U.S. Patent Application Ser. No. 61/725,105 filed on Nov. 12, 2012, the specifications of which is/are incorporated in its entirety herein by reference.

FIELD OF THE INVENTION

The present invention is related to a remote controller, and more particularly a smart remote controller system capable of receiving phone calls via Bluetooth.

BACKGROUND OF THE INVENTION

With the tremendous popularity of Mobile smart devices, the battery life of these devices limits their usage for power heavy applications throughout the day. Most users come home and charge their mobile devices. Charging these devices they are fully charges helps improve the longevity of these devices but most users have to undock these devices when the phone rings. This behavior damages the battery and eventually reduces battery life and adds costs. Most consumers have a universal remote at home which can potentially do more than a remote controller function. The remote can be used as a handset to make or answer calls, enjoy music and browse through your TV shows while the mobile device is charging.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a smart remote controller system which can also receive phone calls from any mobile device via Bluetooth. This remote controller also has speakers and can stream music from the mobile device via Bluetooth while the device is charging on the docking station. The smart remote controller is banana shaped remote which fits comfortable in a user's palm. The top curved area is to control TV, DVR and other devices needing remote controller. The inner face is designed to be a comfortable ear to mouth piece to make/answer calls via the mobile device. One side is a Wi-Fi speaker system playing back music from any mobile device. The handset can be conveniently charged on the docking station when not in use.

DESCRIPTION OF PREFERRED EMBODIMENTS

Figure 1:
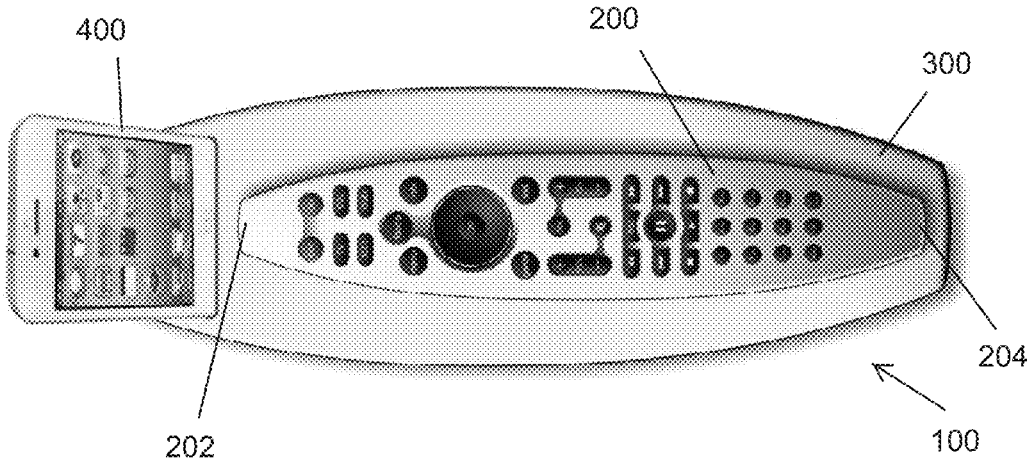
FIG. 1 shows a top view of the smart remote controller system.
Figure 2:
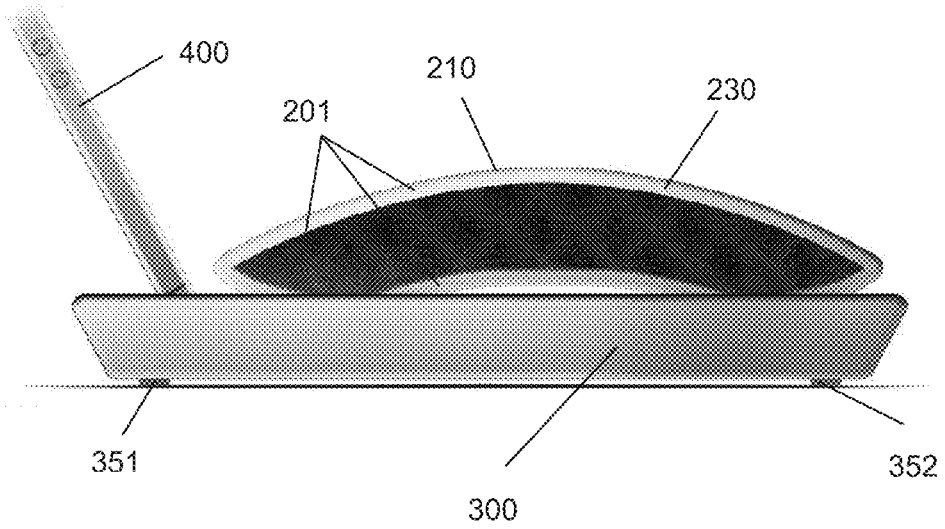
FIG. 2 shows a side view of the smart remote controller system.
Figure 3:
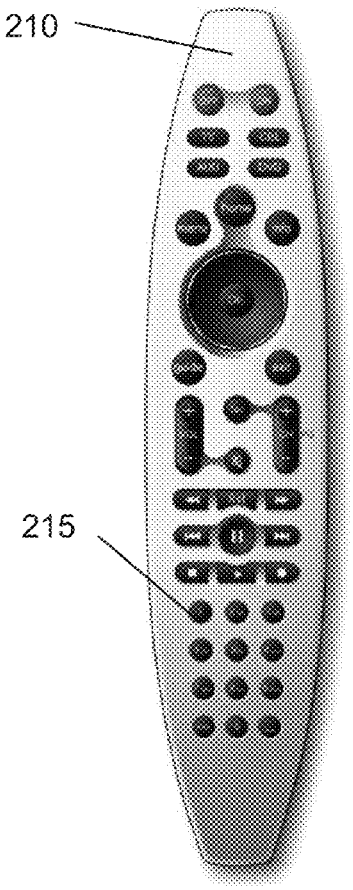
FIG. 3 shows a top view of the smart remote controller.
Figure 4:
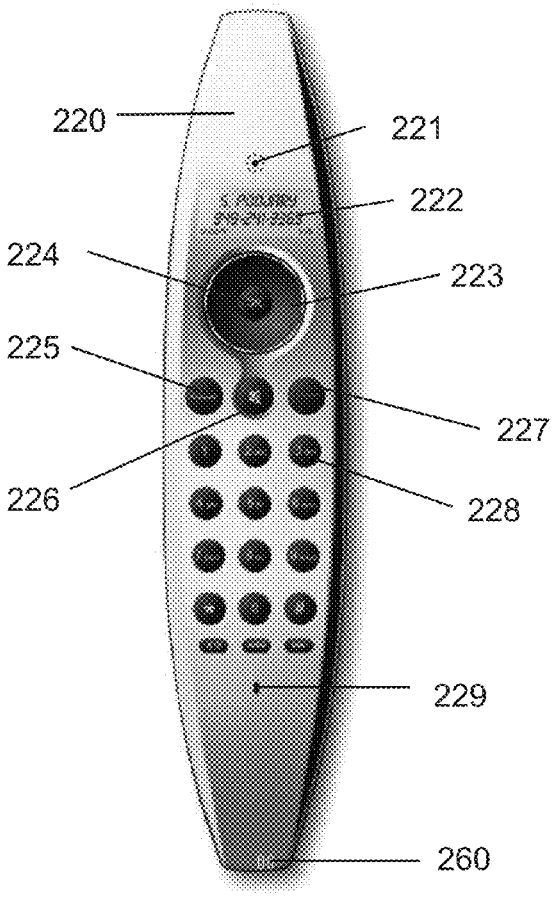
FIG. 4 shows a back view of the smart remote controller.
Figure 5:
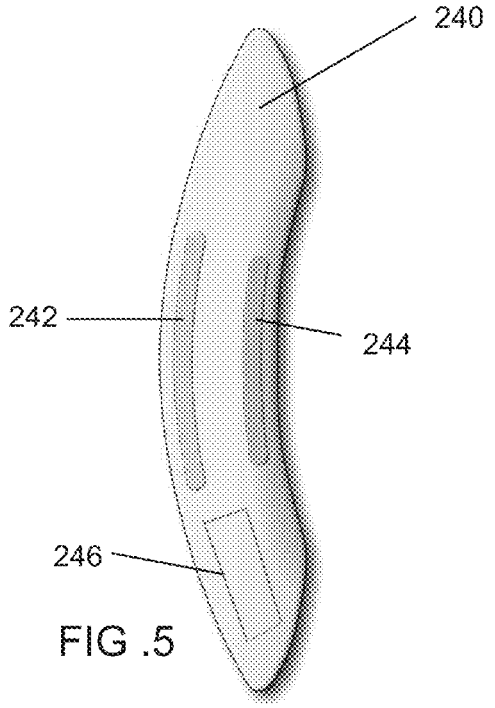
FIG. 5 shows a side view of the smart remote controller.
Figure 6:
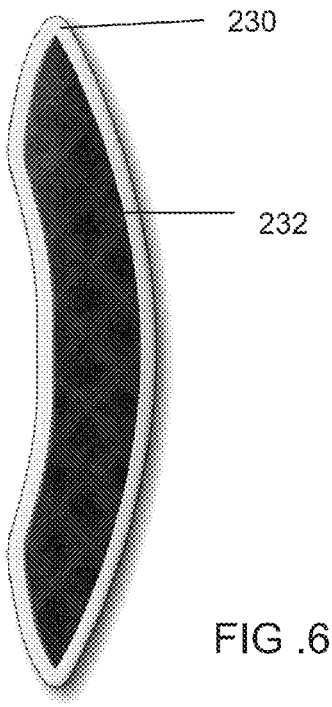
FIG. 6 shows another side view of the smart remote controller.
Figure 7:
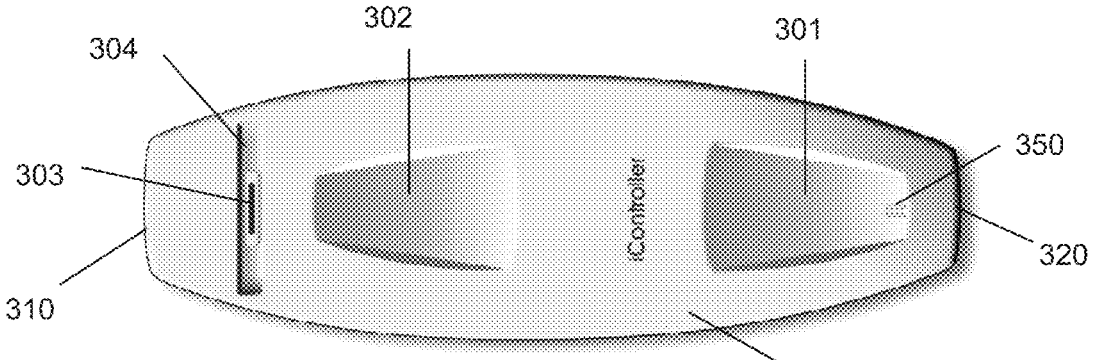
FIG. 7 shows a top view of the docking station.
Figure 8:
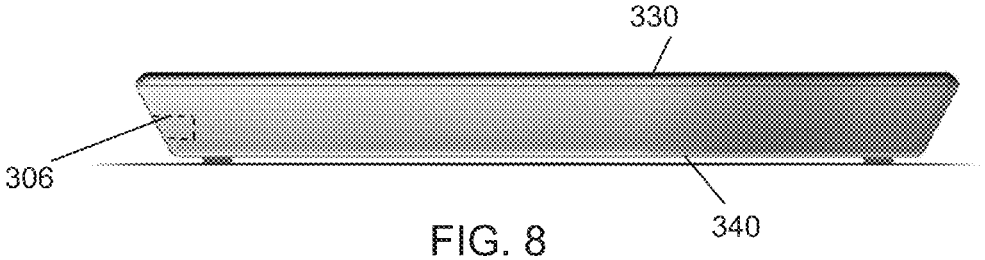
FIG. 8 shows a side view of the docking station.
Figure 9:
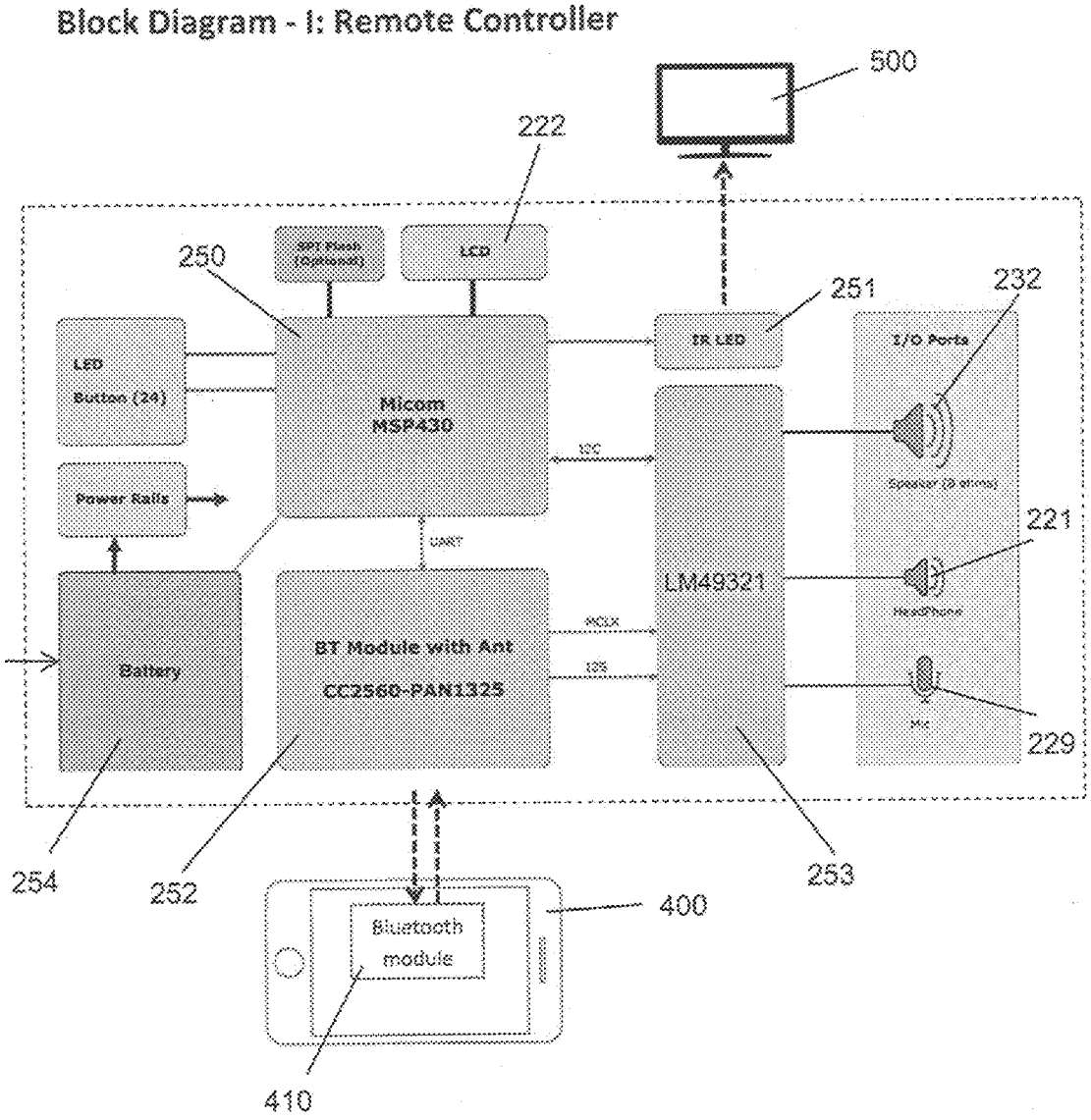
FIG. 9 shows a block diagram of the smart remote controller.
Figure 10:
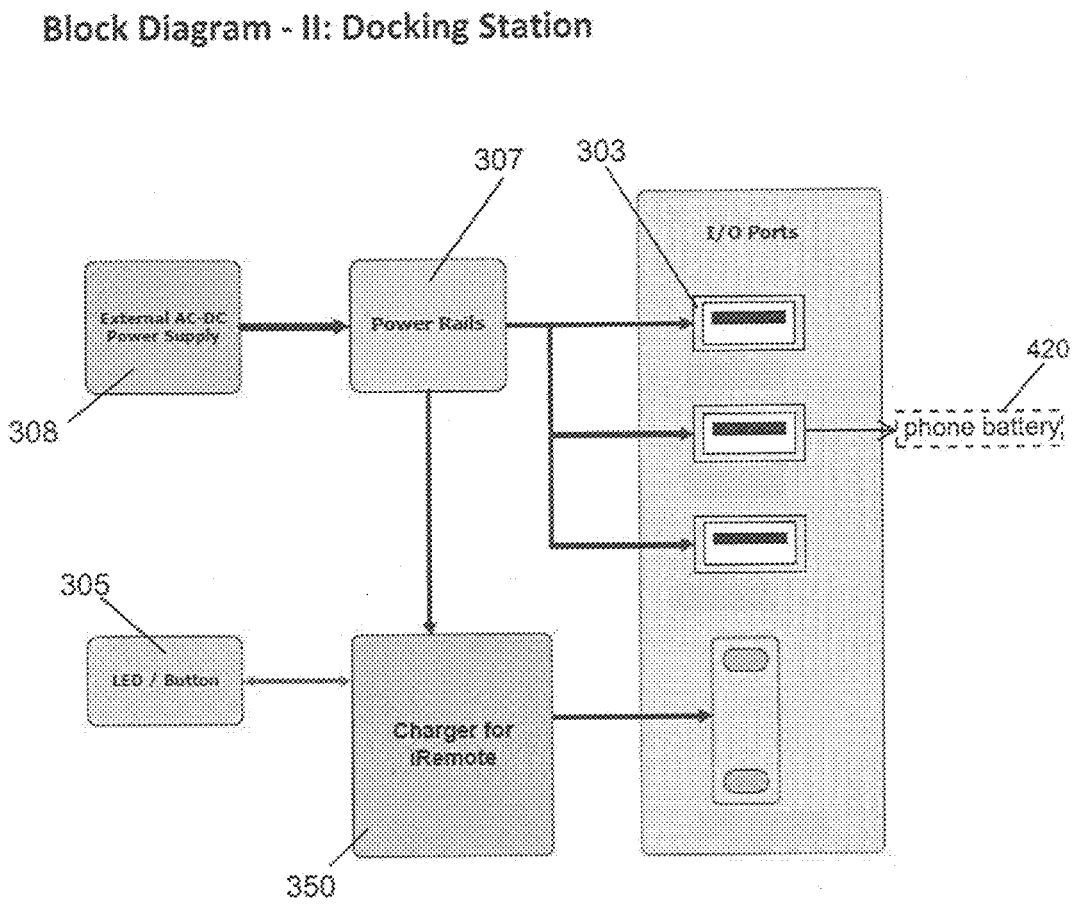
FIG. 10 shows a block diagram of the docking station.

Referring now to FIG. 1-12, the present invention features a smart remote controller system (100) which can also receive phone calls from any mobile device via Bluetooth connection. The system comprises at least a remote controller (200). This remote controller also has speakers and can stream music from the mobile device via Bluetooth while the device is charging on the docking station. The smart remote controller is banana shaped remote which fits comfortable in a user's palm. The top curved area is to control TV, DVR and other devices needing remote controller. The inner face is designed to be a comfortable ear to mouth piece to make/answer calls via the mobile device.

The remote controller (200) has an exterior surface (201) comprising a top side (210), a back side (220), a first side (230) and a second side (240). The remote controller has a first end (202) and second ends (204). A plurality of remote control buttons (215) are disposed on the top side, wherein an infrared LED (251) disposed on the top side near the first end (202). A headphone (221) is disposed on the back side near the first end (202), wherein a microphone (229) is disposed on the back side near the second end (204), wherein a LCD screen (222) is disposed on the back side below the headphone (221), wherein an answering button (225), a stop button (227) and a plurality of number buttons (228) are disposed on the back side (220) between the LCD screen (222) and microphone (229). At least one speaker (232) is disposed on the first side (230). In some embodiments, the speaker (232) is a Hi-Fi speaker. A battery compartment (246) is disposed on the second side with at least one battery (254) resides inside. In some embodiments, the battery (254) inside the remote controller (200) is rechargeable. In some embodiments, the battery (254) is a lithium-ion battery.

The remote controller (200) comprises a microprocessor module (250), a Bluetooth transceiver (252) and a dual-way Analogue/Digital (A/D) converter (253) disposed inside the remote controller (200), wherein the microprocessor module (250) is operatively connected with the remote control buttons (215), headphone (221), LCD screen (222), answering button (225), stop button (227), number buttons (228), microphone (229), Bluetooth transceiver (252), A/D converter (253), speaker (232) and infrared LED (251).

The system comprises at least one Bluetooth smartphone (400) comprising a phone Bluetooth module (410) and a phone battery (420).

The microprocessor module (250) is configured to receive input signal from one of the remote control buttons (215), subsequently generate a corresponding signal and send the generated signal to the infrared LED (251) such that the infrared LED (251) emit a desired infrared signal for remote controlling of a remote device (500) such as a TV or an audio/video player.

The Bluetooth smartphone (400) receives an incoming phone call request, forwarded request signal to the Bluetooth transceiver (252) via phone Bluetooth module (410), the Bluetooth transceiver (252) forwards the request signal to the microprocessor module (250), the microprocessor module (250) then causes the LCD screen (222) to display the request information such as caller's telephone number and applicable name.

If the stop button (227) is pressed, the stop signal is sent to the microprocessor, the microprocessor module (250) receives and sends a rejecting signal to the Bluetooth transceiver (252) so that the Bluetooth transceiver (252) sends the stop signal to the phone Bluetooth module (410) to reject the phone request.

If the answering button (225) is pressed, the answering signal is sent to the microprocessor, the microprocessor module (250) receives and send the answering signal to the Bluetooth transceiver (252) so that the Bluetooth transceiver (252) sends the answering signal to the phone Bluetooth module (410) to start the phone conversation; wherein after the phone conversation started, the microprocessor module (250) receives incoming voice signal from the phone (400) through the phone Bluetooth module (410) via Bluetooth transceiver (252), the microprocessor module (250) causes the headphone (221) to play the incoming voice signal through the A/D converter (253); wherein after the phone conversation started, outgoing voice signal is collected by the microphone (400) and processed by the A/D converter (253) and then send to the microprocessor module (250), the microprocessor module (250) subsequently sends the outgoing voice signal to the phone (400) through the Bluetooth transceiver (252), wherein if the stop button (227) is pressed during the conversation, the stop signal is sent to the microprocessor, the microprocessor module (250) receives and sends a stop signal to the Bluetooth transceiver (252) so that the Bluetooth transceiver (252) sends the stop signal to the phone Bluetooth module (410) to stop the phone conversation.

When the user dials a phone number by pressing the number buttons (228) and pressing the answering button (225), the microprocessor module (250) receives the phone dialling request signal, subsequently generate a corresponding phone dialling request signal and send the generated phone dialling request signal to the Bluetooth transceiver (252) such that the Bluetooth transceiver (252) sends the corresponding phone dialling request signal to the Bluetooth module (410) of the phone (400).

In some embodiments, the microprocessor module (250) has integrated with a built-in memory. In some embodiments, the microprocessor module (250) is a Micom MSP430 microcontroller.

In some embodiments, the Bluetooth transceiver (252) comprises an integrated antenna. In some embodiments, the Bluetooth transceiver (252) is CC2560-PAN1325 Transceiver. In some embodiments, the A/D converter (253) is integrated with audio amplifier. In some embodiments, the A/D converter is a Texas Instrument LM49321 chip.

In some embodiments, the system further comprises a docking station (300) having a first end (310) and second end (320), a top surface (310) and a bottom surface (320), wherein at least one groove (304) is disposed on the top surface (310) near the first end (310); wherein an input/output (I/O) port (303) is disposed within the groove; wherein a first indent (301) is disposed on the top surface (310) near the second end (310) and second indent (302) is disposed on the top surface (310) between the groove (304) and first indent (301); wherein the first indent and second indent hold the remote controller (200); wherein a power receiving port (306) is disposed on the first end (310) to receive power from an external power supply (308), wherein the power port (306) is operatively connected to the I/O port (303) via a power rail (307) disposed within the docking station (300).

In some embodiments, the I/O port (303) is used to charge the battery (420) of the smartphone (400). In some embodiments, the I/O port (303) is a USB port, mini USB port, or a 30-pin dock connector.

In some embodiments, the remote controller (200) has a banana shape with a convex oval profile top side (210) and a concave oval profile back side (220), wherein the first indent and second indent are adaptive to hold the remote controller (200).

In some embodiments, the docking station (300) further comprises a LED light (305) operatively connected to the power rail (307), wherein the LED light (305) is light on when the docking station charges the battery (420) of the smartphone (400). In some embodiments, at least one grip strip (242) is disposed on the second side (240) of the remote controller (200).

In some embodiments, a remote controller charging port (350) is disposed on the first indent (301) or second dent (302) or both indents of the docking station (300), wherein the remote controller charging port (350) is operatively connected to the power receiving port (306).

In some embodiments, the remote controller further comprises a battery charge connector (260) disposed on the first end (202) or second end (204) or both ends of the remote controller, wherein when the remote controller is put on the docking station, the battery charge connector (260) contacts the remote controller charging port (350) on the docking station and the battery (254) is charged.

In some embodiment, the remote controller (200) can stream music from the Bluetooth smartphone (400) via Bluetooth while the smartphone (400) is recharging.

In some embodiment, the remote controller (200) further comprises at least one speaker (232) disposed on the first side (230), a touch wheel (223) and a confirmation button (224) disposed on the back side (220) of the remote controller (200). The touch wheel (223) is disposed below the LCD screen (222), wherein the confirmation button (224) is disposed in the center of the touch wheel (223).

The microprocessor module (250) is operatively connected with the speaker (232), touch wheel (223) and confirmation button (224). The remote controller is configured to stream music stored within the smartphone (400) via Bluetooth connection between the Bluetooth transceiver (252) and phone Bluetooth module (410); wherein after the Bluetooth connection established, the music file list is displayed on the LCD screen (222), wherein a user can play a music file with the press of the confirmation button (224), wherein the music file is played on the speaker (232), wherein a user can do a desired operation to the music list or the music file being played via input to the touch wheel (223).

In some embodiment, the desired operation is next music file, previous music file, fast forward for music being played, fast backward for music being played, volume up for music being played, or volume down for music being played. In some embodiment, the input to the touch wheel (223) is clockwise or counter-clockwise circular movement on the touch wheel. In some embodiment, the music file is MAV, mp3, wma or m4a format.

In some embodiment, the touch wheel (223) is able to be used to scroll up and down a contact list stored within the smartphone (400) when being used as a phone handset after Bluetooth connection between the Bluetooth transceiver (252) and phone Bluetooth module (410) established, wherein the user can scroll to the desired contact and press the answering button (225) to initiate phone call. When used to stream music the touch wheel can be used to scroll the music file list stored in the smartphone (400). In some embodiment, for online streaming from Rhapsody or Pandora, the music will be controlled from the remote controller (200) itself after Bluetooth connection between the Bluetooth transceiver (252) and phone Bluetooth module (410) established. In some embodiment, the LCD display has the size of 16 centimeter×4 centimeter and displays the contact list in phone mode and the music playlist in the smartphone. In some embodiment, the LCD also displays information regarding which phone is ringing and also show if there is a new text message.

In some embodiment, the user can use the remote controller (200) to receive and send text message via Bluetooth connection from/to the smartphone (400) connected. In some embodiment, the user will get an Alert on the handset if there is a new text message on a specific phone. The alert can be a format of sound alert as well as a notice displayed on the screen (222) of the remote controller. In some embodiment, the user can use the remote controller (200) for other functions, such as internet surfing, read/write emails, etc.

In some embodiment, when a user is watching TV with the remote controller (200), the remote controller (200) automatically mutes the TV volume if the user answers a phone call with the remote controller (200). When the uses finished the phone call, the remote controller (200) automatically recovers the TV volume to the original scale. In some embodiment, when the user moves 10-15 feet from the TV, the remote controller (200) automatically recovers the TV volume to the original scale. The distance is detected via a built-in distance detect sensor, such as ultrasonic distance sensor, disposed within the remote controller (200).

Figure 11:
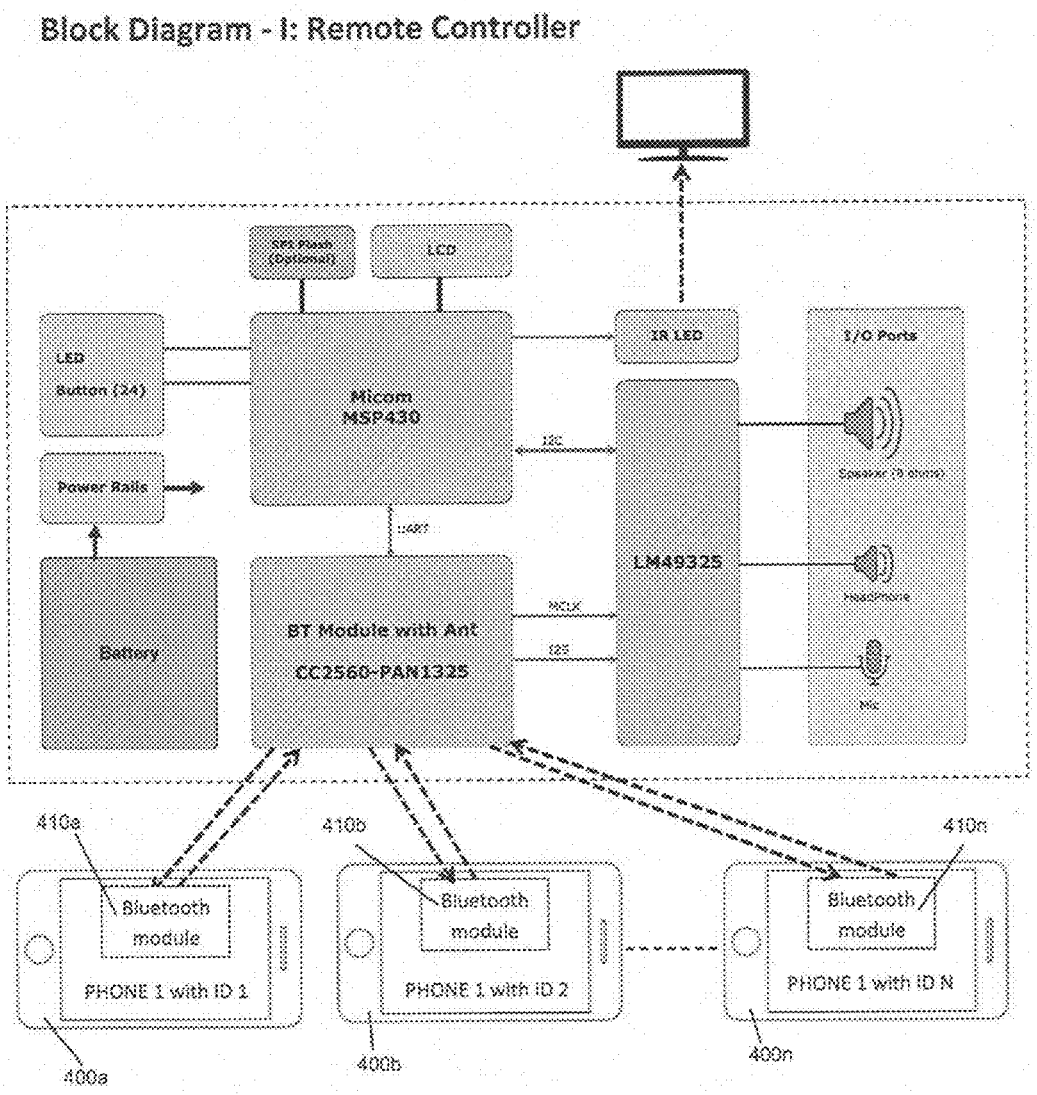
FIG. 11 shows a block diagram of the smart remote controller with Bluetooth connection with multiple phones.

In some embodiments, the remote controller system (100) comprises more than one smartphone and the docket station has more than one input/output (I/O) port (303) for connection the smartphones. As shown in FIG. 11, the remote controller (200) is able to setup Bluetooth connection with multiple phones (400*a*-400*n*). The remote controller (200) is able to select the desired phone to make phone call by choosing the phone ID, which is displayed on the LCD screen (222) on the remote controller (200). When one of the smartphone rings for an incoming call, both the incoming phone call information and the phone ID (receiving phone ID) are displayed on the LCD screen (222) such that the user can see the complete information of the phone call and decide whether and how the phone call needs to be answered.

In some embodiments, wherein when the user dials a phone number by pressing the number buttons (228), choosing the desired phone (400) that the user would like to dial from and subsequently pressing the answering button (225), the microprocessor module (250) receives the phone dialing request signal, subsequently generate a corresponding phone dialing request signal and send the generated phone dialing request signal to the Bluetooth transceiver (252) such that the Bluetooth transceiver (252) sends the corresponding phone dialing request signal to the Bluetooth module (410) of the desired phone (400) and the desired phone (400) starts the phone dialing request.

In some embodiments, the smartphone (400) has an application firmware or software (APP) stored within the phone. Once the APP is executed, the phone (400) starts searching for the remote device. The APP will list all the Bluetooth devices in the range or the APP can be programmed such that it will find the remote controllers only. The APP will enable a user to select from the list of the Bluetooth devices within the detectable range or the list of remote controllers only. In some embodiments, the APP will enable the user to verify the Bluetooth security needs for the Bluetooth connection. In some embodiments, the APP will enable the user to save the profile of the remote controller with a username provided by the user. In some embodiments, the remote controller (200) also comprises a broadcast button to enable the remote controller to start broadcast the unique identification (ID) associated with the remote controller. The remote controller ID will make the APP recognize the remote controller (200).

Figure 12:
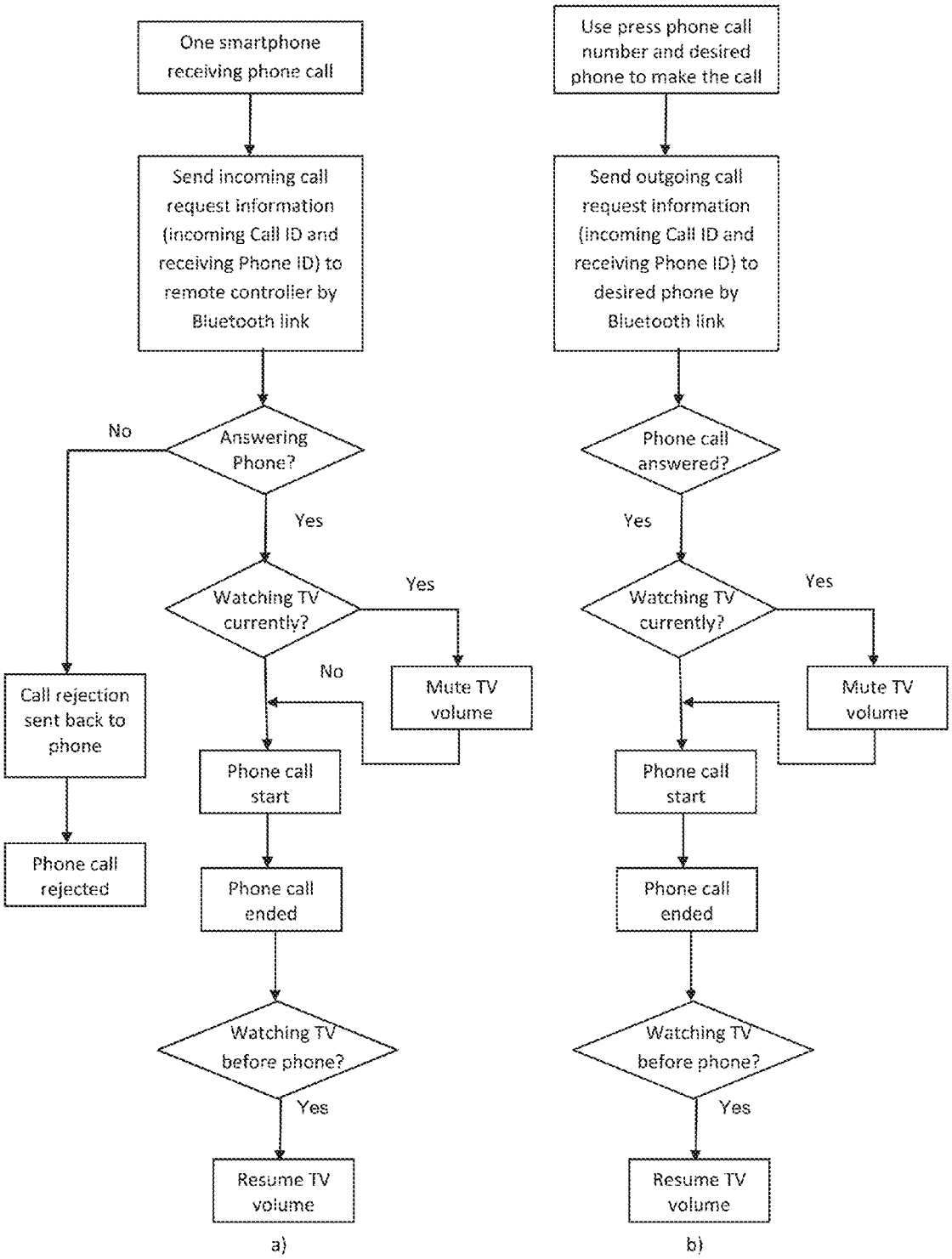
FIG. 12 shows a schematic flow chart of the smart remote controller system.

Shown in FIG. 12 is a schematic flow chart for the smart remote controller system (100). FIG. 12 *a*) shows a schematic flow chart for answering phone calls. FIG. 12 *b*) shows a schematic flow chart for making phone calls. Various modifications of the flow chart will be apparent to those skilled in the art from the foregoing description. Such modifications are also intended to fall within the scope of the appended claims.

The component disclosed on a particular location is for explanatory purpose only. All features and layout herein can be placed at any location on a remote controller (200). For example, all the buttons of the first side (210) and back side (220) can be arranged on the same side. In some embodiments, the first side (210) and back side (220) can be arranged in a folding or sliding configuration with either side capable of hiding within the other side. In some embodiments, the speaker (232) is disposed on either the top side (210) or the back side (220).

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A smart remote controller system capable of receiving and making phone calls for a user with a remote controller, the system comprising:

a remote controller having a top side, a back side, a first side and a second side, wherein the remote controller has a first end and second end, wherein the remote controller comprising:

a plurality of remote control buttons disposed on the top side, an infrared LED disposed on the top side near the first end;

a headphone is disposed on the back side near the first end, a microphone is disposed on the back side near the second end, a LCD screen is disposed on the back side below the headphone; an answering button, a stop button, and a plurality of number buttons are disposed on the back side between the LCD screen and microphone;

a battery compartment is disposed on the second side with at least one battery resides in the battery compartment;

a microprocessor module, a Bluetooth transceiver and a dual-way Analogue/Digital (A/D) converter disposed inside the remote controller, the microprocessor module is operatively connected with the remote control buttons, the headphone, the LCD screen, the answering button, the stop button, the number buttons, the microphone, the Bluetooth transceiver, the A/D converter and the infrared LED;

at least one speaker disposed on the first side;

a touch wheel and a confirmation button disposed on the back side of the remote controller; wherein the touch wheel is disposed below the LCD screen, wherein the confirmation button is disposed in the center of the touch wheel; wherein the microprocessor module is operatively connected with the speaker, touch wheel and confirmation button; and a Bluetooth smartphone comprising: a smartphone Bluetooth module and a phone battery;

wherein the microprocessor module is configured to receive input signal from one of the remote control buttons, subsequently generate a corresponding signal and send the generated signal to the infrared LED; wherein the infrared LED emit a corresponding infrared signal for remote controlling of a remote device;

wherein the a remote device is a TV or an audio/video player;

wherein the Bluetooth smartphone receives an incoming phone call request, subsequently forward a request signal to the Bluetooth transceiver via the smartphone Bluetooth module, the Bluetooth transceiver forwards the request signal to the microprocessor module, the microprocessor module causes the LCD screen to display information corresponding the request signal; wherein the display information comprises caller's telephone number and applicable name;

wherein if a stop button is pressed, an stop signal is sent to the microprocessor, and the microprocessor module sends a rejecting signal to the Bluetooth transceiver, and the Bluetooth transceiver sends the rejecting signal to the smartphone Bluetooth module to reject the incoming phone call request signal;

wherein if an answering button is pressed, an answering signal is sent to the microprocessor, the microprocessor module receives and send the answering signal to the Bluetooth transceiver, the Bluetooth transceiver sends the answering signal to the smartphone Bluetooth module to accept the incoming phone call request signal;

wherein in response to accepting the incoming phone call request signal, the microprocessor module receives incoming voice signal from the Bluetooth smartphone through the smartphone Bluetooth module via the Bluetooth transceiver, the microprocessor module causes the headphone to play the incoming voice signal through the A/D converter;

wherein in response to accepting the incoming phone call request signal, outgoing voice signal is received by the microphone and processed by the A/D converter and forwarded to the microprocessor module, the microprocessor module subsequently sends the processed outgoing voice signal to the Bluetooth smartphone through the smartphone Bluetooth module via the Bluetooth transceiver;

wherein if the stop button is pressed subsequent to accepting the incoming phone call request signal, the stop signal is sent to the microprocessor, the microprocessor module receives and sends the stop signal to the Bluetooth transceiver, the Bluetooth transceiver sends the stop signal to the smartphone Bluetooth module to end a phone conversation; and wherein when the user dials a phone number by pressing the number buttons and subsequently pressing the answering button, the microprocessor module receives a phone dialing request signal, subsequently generate a corresponding phone dialing request signal and send the generated phone dialing request signal to the Bluetooth transceiver, the Bluetooth transceiver sends the corresponding phone dialing request signal to the Bluetooth module of the Bluetooth smartphone and the Bluetooth smartphone starts the phone dialing request;

wherein the remote controller is configured to setup a Bluetooth connection with additional Bluetooth smartphones with a phone ID for each one of the Bluetooth smartphones, wherein the remote controller is configured to selectively initiate phone communications by choosing the desired phone ID, the phone ID for each one of the Bluetooth smartphones is displayed on the LCD screen of the remote controller, wherein when one of the Bluetooth smartphones is receiving an incoming phone call, an incoming phone call information comprising the caller's telephone number and the applicable name are displayed on the LCD screen, and the incoming phone call information is readable by the user.

2. The system of claim 1, wherein the microprocessor module is integrated with a built-in memory.

3. The system of claim 2, wherein the microprocessor module is a Micom MSP430 microcontroller.

4. The system of claim 1, wherein the Bluetooth transceiver comprises an integrated antenna.

5. The system of claim 4, wherein the Bluetooth transceiver is CC2560-PAN1325 Transceiver.

6. The system of claim 4, wherein the A/D converter uses a Texas Instrument LM49321 chip.

7. The system of claim 1, wherein the system further comprises a docking station having a first end, a second end, a top surface, and a bottom surface, wherein at least one groove is disposed on the top surface near the first end;

wherein an input/output (I/O) port is disposed within the groove;

wherein a first indent is disposed on the top surface near the second end and second indent is disposed on the top surface between the groove and first indent;

wherein the first indent and second indent hold the remote controller;

wherein a power receiving port is disposed on the first end to receive power from an external power supply, wherein the power port is operatively connected to the I/O port via a power rail disposed within the docking station.

8. The system of claim 7, wherein the I/O port is used to charge the phone battery of the Bluetooth smartphone.

9. The system of claim 8, wherein the I/O port is at least one of: a USB port, mini USB port, and a 30-pin dock connector.

10. The system of claim 7, wherein the remote controller has a banana shape with a convex oval profile top side and a concave oval profile back side.

11. The system of claim 7, wherein the docking station further comprises a LED light operatively connected to the power rail, wherein the LED light is on when the docking station charges the battery of the Bluetooth smartphone.

12. The system of claim 1, wherein at least one grip strip is disposed on the second side of the remote controller.

13. The system of claim 1, wherein the at least one battery resides in the battery compartment of the remote controller is a rechargeable battery.

14. The system of claim 1, wherein when the user is watching the TV with the remote controller, the remote controller automatically mutes the TV volume if the user accepts the incoming phone call request signal with the remote controller, wherein when the user ends the phone call, the remote controller automatically restores the TV volume to a level of the TV volume prior to muting the muting the TV volume.

15. The system of claim 13, the system further comprises a remote controller charging port disposed on at least one of: the first indent, second indent, and both the first indent and second indents of the docking station, wherein the remote controller charging port is operatively connected to the power receiving port.

16. The system of claim 15, wherein the remote controller further comprises a battery charge connector disposed on the first end or second end or both the first end and second end of the remote controller, wherein when the remote controller is placed on the docking station, the battery charge connector contacts the remote controller charging port on the docking station and the rechargeable battery of the remote controller is charged.

17. The system of claim 1, wherein the remote controller is configured to stream music stored within the Bluetooth smartphone via the Bluetooth connection between the Bluetooth transceiver and smartphone Bluetooth module;

wherein after the Bluetooth connection established, the music file list is displayed on the LCD screen, wherein the user can selectively play a music file from the music file list with the press of the confirmation button, wherein the music file is played on the speaker, wherein the user can perform a desired control operation to the music file list or the music file being played via input to the touch wheel.

18. The system of claim 17, wherein the desired control operation is at least one of: next music file, previous music file, fast forward, fast backward, volume up, and volume down.

19. The system of claim 17, wherein the input to the touch wheel is clockwise or counter-clockwise circular movement on the touch wheel.

20. The system of claim 17, wherein the touch wheel is configured to scroll up and down a contact list stored within the Bluetooth smartphone when the remote controller being used as a phone handset after the Bluetooth connection between the Bluetooth transceiver and smartphone Bluetooth module established, wherein the user can scroll to the desired contact and press the answering button to initiate the phone call.

21. The system of claim 20, wherein when the user dials the phone number by pressing the number buttons, choosing the desired Bluetooth smartphone using the phone ID for each one of the Bluetooth smartphones and subsequently pressing the answering button, the microprocessor module receives the phone dialing request signal, subsequently generate the corresponding phone dialing request signal and send the generated phone dialing request signal to the Bluetooth transceiver, the Bluetooth transceiver sends the corresponding phone dialing request signal to the Bluetooth module of the desired Bluetooth smartphone and the desired Bluetooth smartphone starts the phone dialing request.

* * * * *